US010184651B2

(12) United States Patent
Hikmet et al.

(10) Patent No.: US 10,184,651 B2
(45) Date of Patent: Jan. 22, 2019

(54) LIGHTING DEVICE WITH AN OPTICAL ELEMENT HAVING A FLUID PASSAGE

(71) Applicant: PHILIPS LIGHTING HOLDING B.V., Eindhoven (NL)

(72) Inventors: Rifat Ata Mustafa Hikmet, Eindhoven (NL); Ties Van Bommel, Horst (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 350 days.

(21) Appl. No.: 14/901,861

(22) PCT Filed: Jun. 20, 2014

(86) PCT No.: PCT/EP2014/062979
§ 371 (c)(1),
(2) Date: Dec. 29, 2015

(87) PCT Pub. No.: WO2015/000716
PCT Pub. Date: Jan. 8, 2015

(65) Prior Publication Data

US 2016/0369993 A1 Dec. 22, 2016

(30) Foreign Application Priority Data

Jul. 4, 2013 (EP) ..... 13175016

(51) Int. Cl.
*F21K 9/64* (2016.01)
*F21V 3/02* (2006.01)
(Continued)

(52) U.S. Cl.
CPC ..... *F21V 29/60* (2015.01); *F21K 9/232* (2016.08); *F21K 9/64* (2016.08); *F21V 3/06* (2018.02);
(Continued)

(58) Field of Classification Search
CPC . F21K 9/64; F21K 9/232; F21V 29/83; F21V 29/503; F21V 29/505; F21V 29/506; G02B 6/0016
See application file for complete search history.

(56) References Cited

U.S. PATENT DOCUMENTS 2,870,857 A 1/1959 Goldstein
3,253,675 A 5/1966 Baruch
(Continued)

FOREIGN PATENT DOCUMENTS

CN 201779603 U 3/2011
CN 201916879 U 8/2011
(Continued)

*Primary Examiner* — Alexander K Garlen
(74) *Attorney, Agent, or Firm* — Akarsh P. Belagodu

(57) ABSTRACT

A lighting device (1) comprises at least one light source (3) and at least one optical element (5). The optical element (5) may be arranged to transmit light emitted by the light source (3). The optical element (5) comprises a light transmissive material (7) and at least one passage (9) extending through the light transmissive material (7) for allowing a flow of fluid through said optical element (5). The passage (9) is arranged such that a major portion of the light (16) emitted by said light source (3) entering the passage (9) further propagates through the light transmissive material (7). The optical element (5) comprises a plurality of layers (18) of the light transmissive material (7) spaced apart from each other, each layer comprising at least one through-hole (11).

13 Claims, 3 Drawing Sheets

(51) Int. Cl.

| | |
|---|---|
| ***F21V 3/06*** | (2018.01) |
| ***F21V 3/08*** | (2018.01) |
| ***F21V 5/00*** | (2018.01) |
| ***F21V 9/30*** | (2018.01) |
| ***F21K 9/232*** | (2016.01) |
| ***F21V 29/02*** | (2006.01) |
| ***F21V 29/60*** | (2015.01) |
| ***F21V 29/71*** | (2015.01) |
| ***F21V 29/83*** | (2015.01) |
| ***F21V 29/85*** | (2015.01) |
| ***F21V 29/506*** | (2015.01) |
| ***F21Y 115/10*** | (2016.01) |

(52) U.S. Cl.

CPC ..... *F21V 3/08* (2018.02); *F21V 5/002* (2013.01); *F21V 29/506* (2015.01); *F21V 29/83* (2015.01); *F21V 3/02* (2013.01); *F21V 9/30* (2018.02); *F21V 29/02* (2013.01); *F21V 29/713* (2015.01); *F21V 29/85* (2015.01); *F21Y 2115/10* (2016.08)

(56) References Cited

U.S. PATENT DOCUMENTS

| | | | | |
|---|---|---|---|---|
| 3,373,275 | A | 3/1968 | High | |
| 6,030,104 | A | 2/2000 | Shu | |
| 6,880,948 | B2 * | 4/2005 | Koch | G02B 5/003 362/600 |
| 7,611,260 | B1 | 11/2009 | Lin et al. | |
| 8,967,837 | B2 * | 3/2015 | Tsuei | F21V 3/02 362/235 |
| 2006/0146564 | A1 * | 7/2006 | Lin | G02B 6/0036 362/606 |
| 2009/0101930 | A1 * | 4/2009 | Li | G02B 6/005 257/98 |
| 2011/0049749 | A1 | 3/2011 | Bailey et al. | |
| 2011/0051423 | A1 | 3/2011 | Hand et al. | |
| 2011/0075410 | A1 * | 3/2011 | Negley | G02B 5/0236 362/231 |
| 2011/0298371 | A1 | 12/2011 | Brandes et al. | |
| 2013/0100696 | A1 * | 4/2013 | Brick | F21K 9/00 362/603 |
| 2013/0208469 | A1 * | 8/2013 | Progl | F21V 29/506 362/235 |

FOREIGN PATENT DOCUMENTS

| | | | |
|---|---|---|---|
| CN | 202040621 | U | 11/2011 |
| CN | 202082688 | U | 12/2011 |
| CN | 102767725 | A | 11/2012 |
| CN | 202521279 | U | 11/2012 |
| DE | 2020100033644 | U1 | 5/2010 |
| EP | 2461089 | A1 | 6/2012 |
| EP | 2951493 | A1 | 12/2015 |
| JP | H07158177 | A | 6/1995 |
| JP | 2009211990 | A | 9/2009 |
| WO | 2013050918 | A1 | 4/2013 |
| WO | 2013057610 | A1 | 4/2013 |

* cited by examiner

LIGHTING DEVICE WITH AN OPTICAL ELEMENT HAVING A FLUID PASSAGE

CROSS-REFERENCE TO PRIOR APPLICATIONS

This application is the U.S. National Phase application under 35 U.S.C. § 371 of International Application No. PCT/EP2014/062979, filed on Jun. 20, 2014, which claims the benefit of European Patent Application No. 13175016.8, filed on Jul. 4, 2013. These applications are hereby incorporated by reference herein.

FIELD OF THE INVENTION

The present invention generally relates to heat management in lighting devices.

BACKGROUND OF THE INVENTION

Heat management is an important issue within the field of illumination and, in particular, within the field of solid state based illumination, such as illumination based on light emitting diodes, LEDs. Generally, when light is emitted by a light source, heat is generated. The heat generation is commonly an undesired effect since it can affect performance and life expectance of the light sources, as well as the choice of materials and the configuration of electronics for the lighting device. Heat may also be produced in optical elements of the lighting device, such as in wavelength-converting components by Stokes shift losses.

In order to reduce the effects of the heat generation, lighting devices normally comprise a heat sink arranged to dissipate heat from the light sources and other heat generating components, typically in the direction opposite to the main (or average) light propagation direction of the lighting device. CN202040621 shows a lighting device having holes extending in the heat sink to the surroundings for increasing the heat dissipation area to the surroundings and in the shade of the lighting device.

US 2011/0298371 A1 discloses a LED light bulb with openings in a cover portion. U.S. Pat. No. 3,373,275 A discloses a one piece molded light transmitting lens cover with masked ventilation openings. US 2011/0049749 A1 discloses a replaceable illumination module with a cover cap which includes micro-weave materials with pore sizes large enough for air transfer but too small to convey water droplets. U.S. Pat. No. 3,253,675 A discloses an apparatus for absorbing acoustic energy comprising a light-transmitting member having one or more layers of a porous material which permits the transmission of light therethrough. EP 2461089 A1 discloses a lighting unit with a light transmissive lamp cap having a plurality of vent holes.

However, it would be desirable to achieve alternative solutions for improving heat dissipation from lighting devices.

SUMMARY OF THE INVENTION

It would be advantageous to achieve a lighting device overcoming, or at least alleviating, the above mentioned drawbacks. It would be desirable to enable an alternative lighting device with improved heat management.

To better address one or more of these concerns, a lighting device having the features defined in the independent claim is provided. Preferable embodiments are defined in the dependent claims.

According to an aspect, a lighting device is provided. The lighting device comprises at least one light source, and at least one optical element. The at least one optical element is arranged to transmit light emitted by the light source. The at least one optical element comprises a light transmissive material and at least one passage extending through the light transmissive material for allowing a flow of fluid through the optical element. Further, the passage is arranged such that a major portion of the light emitted by the at least one light source entering the passage further propagates through the light transmissive material. The optical element comprises a plurality of layers of light transmissive material spaced apart from each other, wherein each layer comprises at least one through-hole.

The present aspect is based on the realization that the heat management for a lighting device may be improved by arranging a passage (or hole) in the optical element in front of the light source. The passage allows transfer of heat generated by the light source by means of convection through the passage. In the present specification, the term "convection" may relate to transfer of heat by fluid movement. The fluid flowing through the passage may be the fluid present in the lighting device, which may be of a gaseous form, such as air. Further, the passage may improve dissipation of heat generated in the optical element itself, such as by Stokes shift losses in wavelength-converting materials, which optionally may be arranged in the optical element. The heat generated in the optical element may be transferred through the passage by the fluid flow. Improved heat dissipation from the lighting device may e.g. enable higher operating intensities and/or longer lifetime of the lighting device. With the present aspect, the optical element is utilized to facilitate heat dissipation from the lighting device. The optical element may be used as a complement to (or even instead of) a traditional heat sink, thereby enabling increased overall heat dissipation from the lighting device. Further, as the passage is arranged such that a major portion of the light emitted by the light source entering the passage further propagates through the light transmissive material, the passage has a limited influence on the light distribution of the lighting device. In other words, the passage is arranged such that a reduced amount of light is allowed to propagate directly through the passage without passing the light transmissive material. Hence, most of the light entering the passage interacts with the light transmissive material upon transmission through the optical element. Interaction with the light transmissive material should be understood as any type of interaction such as transmission, reflection, scattering, absorption and/or re-emission of light. Thus, the passage is formed by the fluidly interconnected through-holes and at least one space between the layers of light transmissive material. The space between the layers of light transmissive material may allow circulation of fluid between the layers, which may further improve heat convection. The circulation of fluid may be adjusted by adjusting the distance of the layers of light transmissive material, which influences the turbulence of the flow of fluid in the passage.

In the present specification, the term "light transmissive material" is to be widely interpreted as any material or combination of materials (or substances) admitting at least some transmission of light. For example, the light transmissive material may comprise transparent and/or translucent material (such as ceramics or plastics) and, optionally, particles (e.g. for scattering and/or wavelength conversion of light) embedded therein and/or applied thereto.

According to an embodiment, any line of sight extending from the light source and through the passage crosses the light transmissive material, whereby the influence of the passage on the light distribution of the lighting device is further reduced. With the present embodiment, an increased amount of light from the light source entering the passage may interact with the light transmissive material at least once upon passing the optical element. As there is no line of sight, which extends from the light source through the passage without passing the light transmissive material, the light source is not directly visible from outside of the optical element through the passage, whereby glare from the light source is reduced.

According to an embodiment, at least two of the layers of light transmissive material may be arranged such that light transmissive material of one of the two layers laterally overlap the through-hole in the other one of the two layers, whereby a major portion of the light entering one of the through-holes further propagates through at least one of the other layers of light transmissive material. Thus, light entering one of the through-holes may interact at least once with the light transmissive material in one of the layers upon passing (or propagating through) the optical element.

According to an embodiment, the passage may have a shape adapted such that an imaginary straight line between a first opening and a second opening of the passage (such as between two opposite openings of the passage) may cross the light transmissive material. Hence, the passage may have any non-straight shape, such as a curved or cornered shape. As light naturally propagates in a straight direction, light entering the passage will pass the light transmissive material if the passage is non-straight. With the present embodiment, the optical element may not necessarily comprise several layers of light transmissive material. Instead, the optical element may comprise a single layer of transmissive material through which the passage extends. The position of the optical element relative to the light source may be less critical with regard to reducing the amount of light entering the passage without further propagating through the light transmissive material, as the non-straight shape of the passage may (at least partially) inhibit light from passing the passage without also passing the light transmissive material.

According to an embodiment, the optical element may be provided with a plurality of passages, whereby the convection of heat is further improved. Further, the area of the optical element exposed to the flow of fluid increases, which improves dissipation of heat from the optical element into the passages.

According to an embodiment, the optical element may comprise a porous material comprising pores extending through the light transmissive material, whereby the pores form the passages for flow of fluid through the optical element. The pores may e.g. extend between two opposite surfaces of optical element. The extension of the pores through the optical element may be winding (or at least non-straight), whereby light emitted by the light source entering a pore further propagates through the light transmissive material surrounding the pore. Furthermore, the winding pores increase the area of the light transmissive material exposed to the flowing fluid, whereby dissipation and convection of heat is improved. Further, the porous light transmissive material comprises multiple refractive index shifts at the interfaces between the light transmissive material and the voids (typically comprising the fluid) formed by the pores, whereby the optical element may be used as a diffuser of the lighting device. Multiple refractive index shifts may provide scattering of light propagating through the porous material. The transmissive material may preferably have a higher refractive index compared to that of the fluid (e.g. air).

According to an embodiment, the volume of the pores may make up at least 30% of the total volume of the optical element, which increases the convection and dissipation of heat from the optical element.

According to an embodiment, the at least one optical element may be any one of a wavelength converting element, a diffuser element, and a combination of a diffuser and a wavelength converting element. Hence, the optical element may be arranged to adjust properties of light emitted by the light source. The optical element may for example be arranged to scatter light emitted by the light source in order to provide a more uniform light distribution (often perceived as softer light) of the lighting device. Heat producing processes may occur in the light transmissive material, in particular if the light transmissive material comprises wavelength converting material (e.g. phosphor). For example, exothermic chemical reactions may be initiated by light and Stokes losses may result from absorption and re-emission of light in the light transmissive material. The passage providing a flow of fluid, and thereby heat convection, through the optical element may facilitate dissipation of heat generated by such processes in the optical element.

According to an embodiment, the light transmissive material may comprise particles for scattering (e.g. $TiO_2$, $BaSO_4$ and/or $Al_2O_3$ particles) and/or converting a wavelength of light emitted by the light source. The particles in the light transmissive material may be reflective (e.g. opaque, such as white) for scattering light. The particles may be wavelength converting particles having an atomic (or molecular) structure having an energy gap corresponding to the energy of the light emitted by the light source. Generally, whenever light is absorbed and re-emitted by the particles, the wavelength of the light is increased. Most of the energy loss defined by the difference in energy prior to the absorption and after the re-emission is emitted as heat radiation. The heat convection through the optical element may facilitate dissipation of the heat resulting from such a wavelength conversion.

According to an embodiment, the optical element may be positioned at a distance from the at least one light source being larger than 2 cm, such as larger than 3 cm or 5 cm. Such a distance allows the fluid to circulate more freely between the optical element and the light source, which facilitates transfer of fluid out through the passage, whereby an increased amount of fluid can pass through the passage per time unit.

According to an alternative embodiment, the at least one optical element may be positioned at a distance from the at least one light source being closer than 3 mm, such as closer than 2 mm, 1 mm or 0.5 mm, which provides a reduced size of (more compact) lighting device.

According to an embodiment, a ratio of the thickness of the light transmissive material to the average diameter of the passage is at least 2, such as at least 4 or 6. An increased ratio between the thickness of the optical element (or at least of the light transmissive material surrounding the passage) and the width of the passage reduces the amount of light passing through the passage without interacting with the light transmissive material.

In embodiments, the lighting device may further comprise active cooling means arranged to produce a flow of fluid through the at least one passage, preferably in direction away from the light source. The active cooling means may enhance the flow of fluid produced by the heat convection effect, thereby improving the heat dissipation from the lighting device. The active cooling means may e.g. comprise a fan.

Further features of, and advantages with, the present invention will become apparent when studying the appended claims and the following detailed description. The skilled person realize that different features of the present invention may be combined to create embodiments other than those described in the following, without departing from the scope of the present invention.

BRIEF DESCRIPTION OF THE DRAWINGS

The present aspect, including its particular features and advantages, will be readily understood from the following detailed description and the accompanying drawings.

Figure 1:
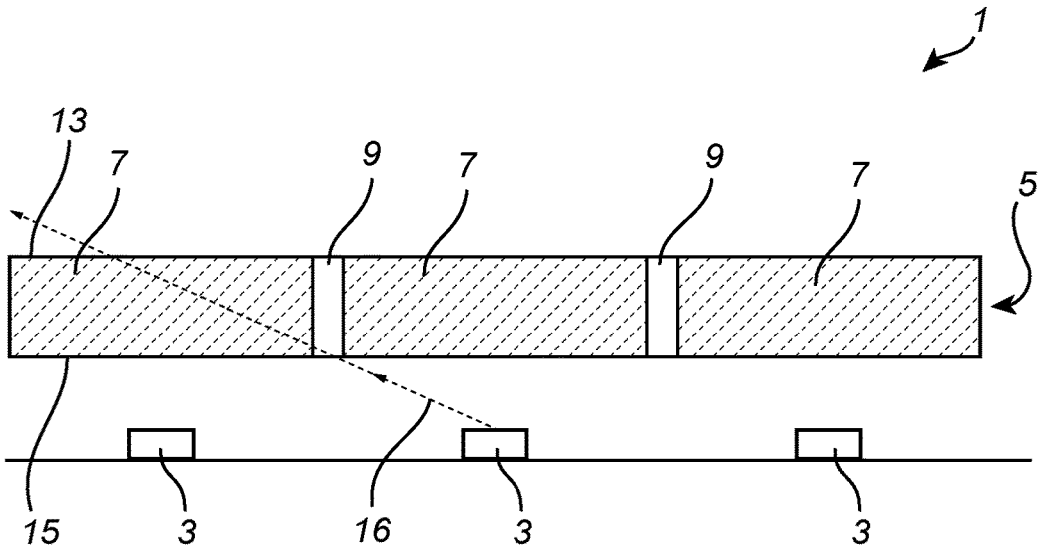
FIG. 1 is a cross-section of a lighting device having one or more through holes or passages.

All figures are schematic, not necessarily to scale, and generally only show parts which are necessary to elucidate the invention, wherein other parts may be omitted or merely suggested.

DETAILED DESCRIPTION

Embodiments of the present invention will now be described more fully hereinafter with reference to the accompanying drawings. The invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

With reference to FIG. 1, a general embodiment of a lighting device 1 having one or more through holes will be described. FIG. 1 is a cross-section of the lighting device 1.

The lighting device 1 comprises one or more light sources 3, such as solid state based light sources (e.g. light emitting diodes, LEDs), and an optical element 5 arranged to transmit light emitted by the light sources 3. The optical element 5 comprises light transmissive material 7 and one or more (in the present example two) passages, or in this case through-holes, 9 extending through the light transmissive material 7 from a first surface 13 to a second surface 15 of the optical element 5. Hence, the passages 9 extend between opposite sides of the optical element 5.

The passages 9 are arranged to allow a flow of fluid through the optical element 5, such as out of a space defined between the light sources 3 and the optical element 5. The fluid flowing through the passages 9 may be the fluid present in the lighting device 1, such as any gaseous fluid and preferably air. Fluid surrounding the optical element 5 circulates in and out of the passages 9 of the optical element 5, thereby providing heat convection. Thus, the flow of fluid removes heat present in the space between the light sources 3 and the optical element 5, which facilitates heat dissipation from the lighting device 1.

The configuration of the passages 9 and the positioning of the light sources 3 relative to the passages 9 is adapted such that a major portion (preferably substantially all) light 16 emitted by the light sources 3 entering the passages 9 further propagates through the light transmissive material 7. In other words, a majority of the light emitted by the light sources 3 passing through the passages 9 interacts at least once with the light transmissive material 7. Preferably, the passages 9 are configured such that any line of sight extending from each light source 3 and crosses a passage 9 at any point also crosses the light transmissive material 7. In other words, the light sources 3 are not directly visible through the passages 9 when looking at the first surface 13 of the optical element 5. The amount of light, which enters the passages 3 and subsequently interacts with the light transmissive material 7 is determined by the shape of the passages 9, the dimensions of the passages 9 relative to the surrounding light transmissive material 7 and the position of the passages 9 relative to the light sources 3.

According to an example, the aspect ratio of the thickness of the light transmissive material 7 to the average diameter of the passages 9 is at least 2, such as at least 4 or 6. Hence, the light transmissive material 7 may be significantly thicker than the width of the passages 9. Further, positioning of the light sources 3 with respect to the passages 9 may be adapted to the angle of spread of the light sources 3.

In the present example, the passages 9 of the optical element 5 may be (substantially) straight through-holes arranged in a sheet of light transmissive material 7. The passages 9 may e.g. have a substantially cylindrical shape with any convenient cross-section, such as a circular, polygon, elliptic, hyperbolic or parabolic shape.

Alternative configurations of the passages 9 will be described in the following.

Figure 2:
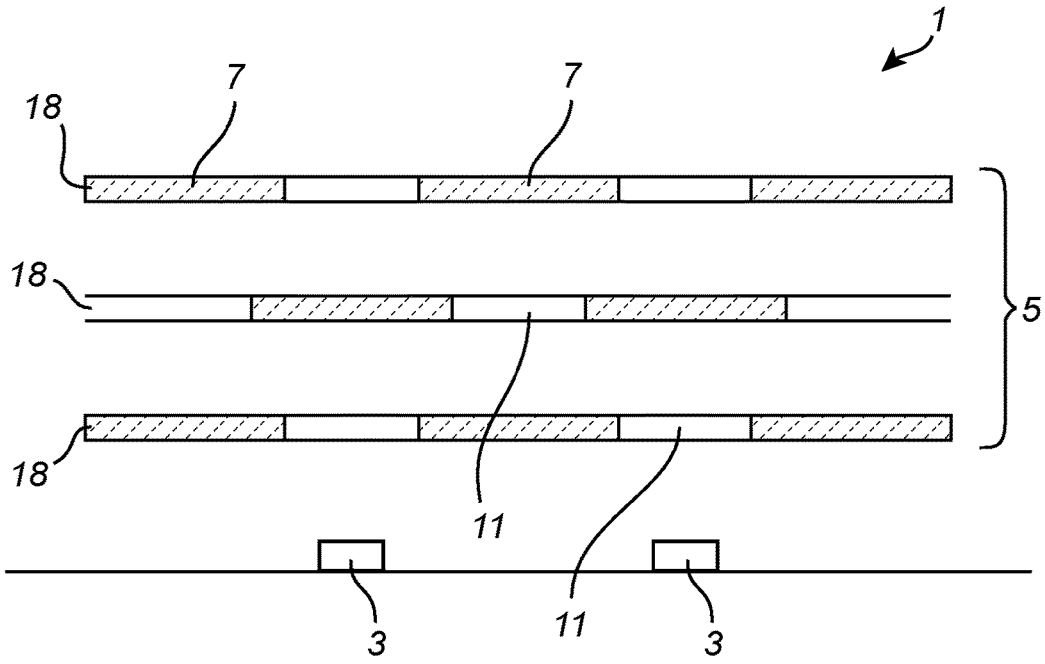
FIG. 2 is a cross-section of a lighting device according to an embodiment of the invention.

A lighting device 1 according to an embodiment of the invention will be described with reference to FIG. 2. The lighting device may be similarly configured as the lighting device described with reference to FIG. 1, except that the optical element 5 comprises a plurality of layers 18 of light transmissive material 7 and each layer 18 has at least one through-hole 11. The passages for allowing the flow of fluid through the optical element 5 are in this embodiment formed by the fluidly interconnected through-holes 11 and the spaces defined between the layers 18. Preferably, the total volume of the layers 18 may be rather small compared to the total volume of the passages (i.e. the through-holes 11 and the space between the layers 18) for facilitating circulation of fluid in the passages and thereby improving the heat convection through the optical element 5. The distances between the different layers 18 may be equal to each other or vary.

Figure 3:
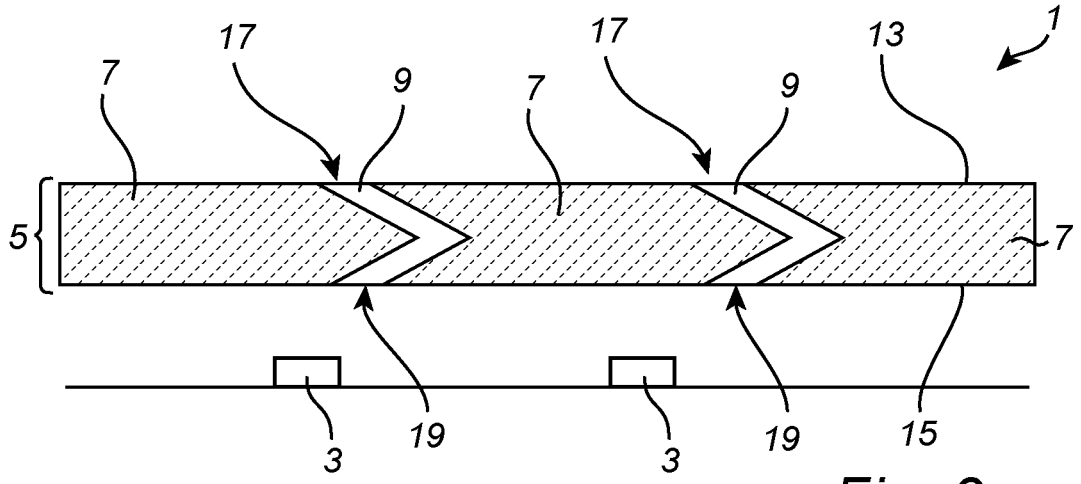
FIG. 3 is a cross-section of a lighting device according to another embodiment of the invention.
Figure 4:
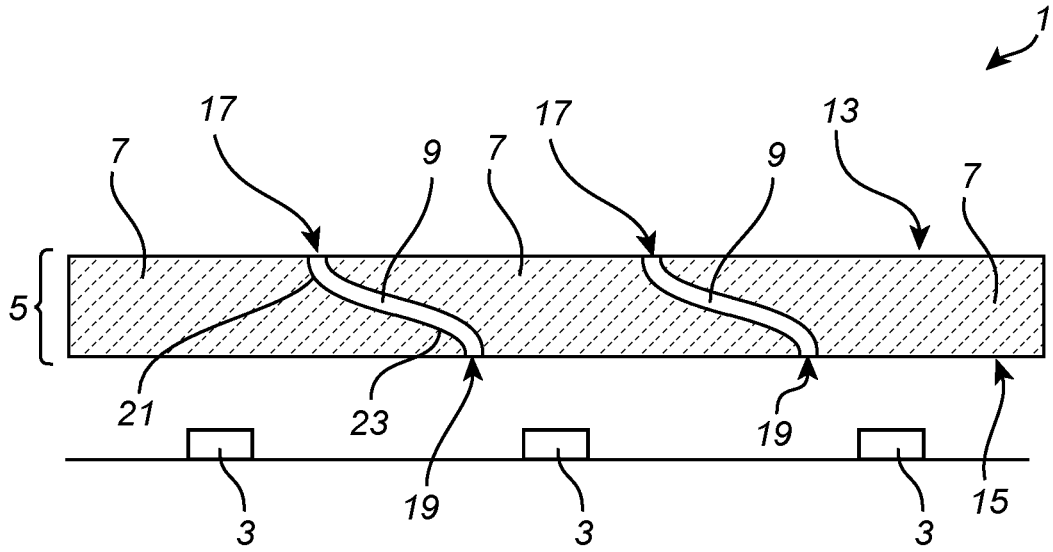
FIG. 4 is a cross-section of a lighting device according to yet another embodiment of the invention.
Figure 5:
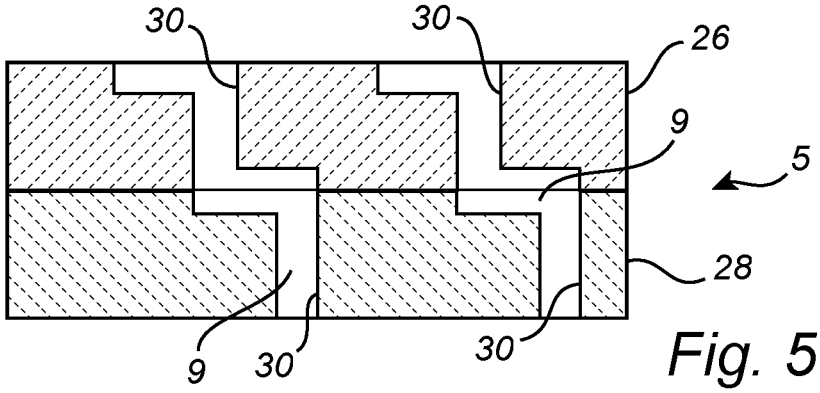
FIG. 5 is a cross-section of an optical element of a lighting device according to yet another embodiment of the invention.

A lighting device 1 according to general embodiments of a lighting device having through holes or passages will be described with reference to FIGS. 3 and 4. The lighting device may be similarly configured as the lighting device described with reference to FIG. 1, except that the passages 9 are shaped such that an imaginary straight line between a first opening 17 and a second opening 19 of the passage 9 crosses the light transmissive material 7 of the optical element 5, whereby heat transportation through the passages 9 may be effected without causing glare from the light sources 3. For example, the passages 9 may be cornered, as illustrated in FIG. 3, or curved as illustrated in FIG. 4. The passages 9 of the lighting device shown in FIG. 4 may e.g. be S-shaped having a first curve 21 near the opening 17 at the first surface 13 of the optical element 5 and a second curve 23 near the opening 19 at the second surface 15 of the optical element 5. The first curve 21 and the second curve 23 may be interconnected by a part of the passage 9 that is substantially horizontal or slightly tilted. However, it will be appreciated that the passages 9 may have any non-straight shape allowing light emitted by the light sources entering the passages to further propagate through the light transmissive material 7. The optical element 5 comprising the curved or cornered passages 9 may be formed by placing two or more layers 26, 28 of light transmissive material on top of each other, wherein each layer comprises at least one recess 30, as illustrated in FIG. 5. In another embodiment (not shown) the two layers 26,28 are spaced apart. Also for the embodiment shown in FIG. 3, the optical element 5 may comprise two spaced apart layers split at a plane where the corner of the passages is formed. The recesses 30 are shaped and arranged such that, when the layers 26, 28 are joined, a recess 30 of one 26 of the layers overlaps a recess of the other 28 layer such that they together form a passage 9 extending through the optical element 5. Further, the curved and/or cornered passages 9 may be formed by means of 3D printing of the optical element 5.

Figure 6:
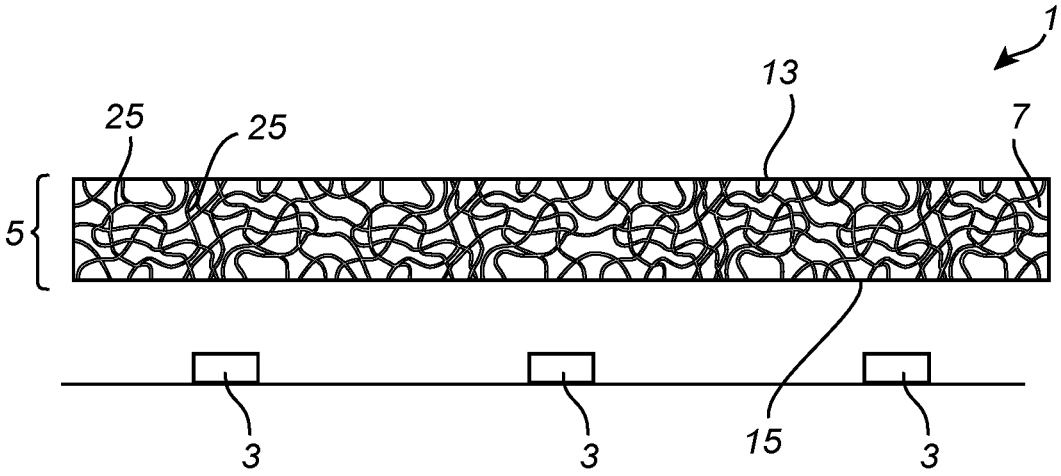
FIG. 6 is a cross-section of a lighting device according to yet another embodiment of the invention.

A lighting device 1 according to yet another embodiment will be described with reference to FIG. 6. The lighting device may be similarly configured as the lighting device described with reference to FIG. 1, or as described with reference to FIG. 2 comprising two or more optical elements, except that the optical element 5 comprises a porous material with a plurality of pores 25 extending through the light transmissive material 7 between the first surface 13 and the second surface 15. The pores 25 form the passages in the optical element 5 for allowing a flow of fluid through the optical element 5. The pores 25 may have a relatively narrow diameter and random winding shape, whereby light emitted by the light sources entering a pore 25 further propagates through the light transmissive material 7. The volume of the pores may make up at least 30% of the total volume of the optical element 5 for facilitating heat convention.

Figure 7:
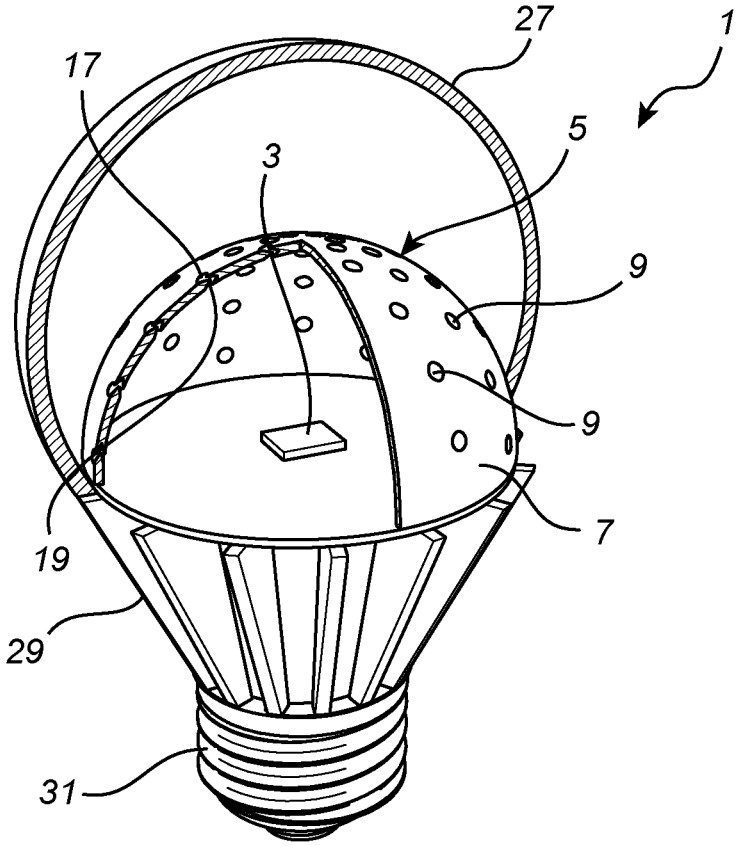
FIG. 7 is a perspective, partly cut-away, view of a lighting arrangement according an embodiment of the invention.

According to an embodiment, the lighting device 1 may e.g. be a retrofit LED-based lighting device, as illustrated in FIG. 7. However, the lighting device may be any type of lighting arrangement and is not limited to LED-lamps or luminaires. The lighting device may e.g. be implemented in a lamp, luminaire, light engine or a system comprising several lighting devices. For example, the lighting device 1 may be used in one or more of the following applications: shop lighting systems, home lighting systems, accent lighting systems, spot lighting systems, theatre lighting systems, decorative lighting systems, portable lighting systems, automotive lighting applications, projection systems, display systems, warning sign systems, medical lighting application systems, indicator sign systems, and household application systems.

The lighting device 1 may optionally comprise an enclosure (or envelope) 27, which together with the heat sink 29 (or lower portion of the lighting device) encloses the optical element 5 and the light source 3. The enclosure 27 may have the shape of a bulb. Optionally, the lighting device 1 may further comprise a socket 31 for coupling the lighting device 1 to a lamp fixture.

The optical element 5 may be arranged in front of the light source 3, e.g. to cover or enclose the light source 3. For example, the optical element 5 may have a sphere-like (or dome-like) shape. An inner volume between the optical element 5 and the light source 3 is fluidly connected to an outer volume between by the enclosure 27 and the optical element 5 via the passages 9. Hence, the passages 9 are arranged to enable a flow of air between the inner volume and the outer volume of the lighting device 1 to transport the heat produced from the light sources 3 and the optical element 5 to the outer volume. Thus, the hampering of heat dissipation from the light source 3 resulting from the arrangement of an optical element 5 in front of the light source 3 is partly compensated by the heat convection effected by the passages 9, while still enabling (at least most of) the light emitted by the light source 3 to interact with the light transmissive material 7.

In an embodiment, the lighting device 1 may further comprise active cooling means (not shown) arranged to produce a flow of fluid through the passages 9, preferably in direction away from the light source 3. For example, the active cooling means may be configured to produce a flow of fluid in the heat conduction direction, i.e. from the inner volume to the outer volume in the lighting device 1. The active cooling means may enhance the flow of fluid produced by the heat convection effect. The active cooling means may e.g. comprise a fan.

In the following, the light transmissive material 7 will be described in more detail. The light transmissive material 7 may comprise a transparent or translucent bulk material, such as glass or plastics. The light transmissive material 7 may further include scattering particles for scattering light emitted by the light source 3. The optical element 5 may comprise particles causing an exothermic reaction when illuminated such that heat is produced. Heat generated in the light transmissive material 7 may be dissipated partly via the heat convection in the passages.

Further, the light transmissive material 7 in the optical element 5 may comprise wavelength converting material, such as a phosphor. Particles of the wavelength converting material absorb and re-emit light through fluorescence, phosphorescence, luminescence, chemiluminscence or a combination thereof.

Examples of suitable wavelength converting materials are organic luminescent materials based on perylene derivatives. Preferably, the organic luminescent material may be transparent and non-scattering.

Furthermore, the wavelength converting material may comprise quantum dots or quantum rods. Quantum dots are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with shell such as cadmium sulfide (CdS) and zinc sulfide (ZnS). Cadmium free quantum dots such as indium phosphide (InP), and copper indium sulfide ($CuInS_2$) and/or silver indium sulfide ($AgInS_2$) can also be used. Quantum dots show very narrow emission band and, thus, they show saturated colors. Furthermore, the emission color can be tuned by adapting the size of the quantum dots. Any type of quantum dot may be used in the light transmissive material 7.

Further, the light transmissive material 7 may comprise an inorganic phosphor. Examples of inorganic phosphor materials include, but are not limited to, cerium (Ce) doped YAG ($Y_3Al_5O_{12}$) or LuAG ($Lu_3Al_5O_{12}$). Ce doped YAG emits yellowish light, whereas Ce doped LuAG emits yellow-greenish light. Examples of other inorganic phosphors materials which emit red light may include, but are not limited to ECAS and BSSN; ECAS being $Ca_{(1-x)}AlSiN_3:Eu_x$ wherein $0<x\leq1$, preferably $0<x\leq0.2$; and BSSN being $Ba_{(2-x-z)}M_xSi_{(5-y)}Al_yN_{(8-y)}O_y:Eu_z$ wherein M represents Sr or Ca, $0\leq x\leq1$, $0\leq y\leq4$, $0.0005\leq z\leq0.05$, and preferably $0\leq x\leq0.2$).

Even though the invention has been described with reference to specific embodiments thereof, many different alterations, modifications and the like will become apparent for those skilled in the art. The embodiments described with reference to the drawings are all combinable with each other. For example, different types of passages, such as through-holes and pores, may be interchanged or combined in the optical element. Moreover, other types of light sources than LEDs may be used, such as light sources of the incandescent, gas discharge, halogen or high intensity discharge types.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A lighting device comprising:

at least one light source; and at least one optical element arranged to transmit light emitted by the light source, said optical element comprising a light transmissive material and at least one passage extending through the light transmissive material, wherein the passage is arranged such that a major portion of the light emitted by said light source entering the passage further propagates through the light transmissive material, wherein the at least one optical element comprises at least two layers spaced apart from each other and made of the light transmissive material, each of the at least two layers comprises a plurality of through holes that constitutes at least a portion of said at least one passage, for allowing a flow of fluid through the at least two layers of said optical element, and wherein the through holes of one of the at least two layers are misaligned with the through, holes of another one of the at least two layers so as to reduce glare from the light source.

2. The lighting device according to claim 1, wherein any line of sight extending from the light source and through the passage crosses the light transmissive material.

3. The lighting device according to claim 1, wherein the passage has a shape adapted such that an imaginary straight line between a first opening and a second opening of the passage crosses the light transmissive material.

4. The lighting device according to claim 1, wherein the optical element is provided with a plurality of passages.

5. The lighting device according to claim 1, wherein the optical element comprises a porous material comprising pores extending through the light transmissive material.

6. The lighting device according to claim 5, wherein the volume of the pores makes up at least 30% of the total volume of the optical element.

7. The lighting device according to claim 6, wherein the at least one optical element is any one of a wavelength converting element, a diffuser element, and a combination of a diffuser and a wavelength converting element.

8. The lighting device according to claim 6, wherein the light transmissive material comprises particles for scattering and/or converting a wavelength of light emitted by the light source.

9. The lighting device according to claim 6, wherein the optical element is positioned at a distance from the at least one light source being larger than 2 cm, such as larger than 3 cm, 1 cm or 0.5 cm.

10. The lighting device according to claim 6, wherein at least one optical element is positioned at a distance from the at least one light source being closer than 3 mm, such as closer than 2 mm, 1 mm or 0.5 mm.

11. The lighting device according to claim 1, wherein a ratio of the thickness of the light transmissive material to the average diameter of the passage, is at least 2, such as a least 4 or 6.

12. The lighting device according to claim 6, further comprising a fan arranged to produce a flow of fluid through the at least one passage.

13. A lamp, luminaire or light engine comprising the lighting device according to claim 1.

* * * * *